US005644849A

United States Patent [19]

Slates

[11] Patent Number: 5,644,849

[45] Date of Patent: Jul. 8, 1997

[54] BOW SIGHT MOUNT FOR ABSORBING THE FORCES OF SHEAR

[75] Inventor: Scott O. Slates, County of St. Charles, Mo.

[73] Assignee: Toxonigs Manufacturing, Inc., Wentzville, Mo.

[21] Appl. No.: 558,712

[22] Filed: Nov. 16, 1995

[51] Int. Cl.[6] ..... F41G 1/467

[52] U.S. Cl. ..... 33/265; 124/87

[58] Field of Search ..... 33/265, 241; 124/87

[56] References Cited

U.S. PATENT DOCUMENTS

| | | | |
|---|---|---|---|
| 3,526,037 | 9/1970 | Crosby | 33/265 |
| 3,787,984 | 1/1974 | Bear et al. . | |
| 3,854,217 | 12/1974 | Killian . | |
| 4,026,032 | 5/1977 | Smith | 33/265 |
| 4,317,288 | 3/1982 | Yasui . | |
| 4,417,403 | 11/1983 | Strange . | |
| 4,761,888 | 8/1988 | Kudlacek . | |
| 4,875,290 | 10/1989 | Finch . | |
| 4,977,677 | 12/1990 | Troescher, Jr. | 33/265 |
| 5,001,837 | 3/1991 | Bray . | |
| 5,303,479 | 4/1994 | Rudovsky . | |
| 5,341,791 | 8/1994 | Shafer . | |
| 5,379,746 | 1/1995 | Sappington . | |
| 5,384,966 | 1/1995 | Gibbs . | |
| 5,414,936 | 5/1995 | Sappington | 33/265 |
| 5,517,979 | 5/1996 | Closson | 33/265 |

*Primary Examiner*—Thomas B. Will
*Attorney, Agent, or Firm*—Paul M. Denk

[57] ABSTRACT

An archery bow and bow string having a bowsight frame carried by the bow subject to vibration shock and shear forces on release of the bow string, including a vibration shock absorbing attachment for connection of the bowsight frame to its assembly, incorporating a cylindrical frame member, having a threaded shaft projecting outwardly from the frame, the shaft having a headed end in the frame, a bushing received on the shaft in the frame with the headed end abutting against the threaded shaft headed end; a sight alignment sleeve threaded upon the shaft, the alignment sleeve also having a headed end presented against the frame, and a shock absorbing pad disposed on the threaded shaft between the sleeve headed end and the frame in order to provide an inherently resilient type of shock absorbing device where the bow sight cylindrical frame mounts to its supporting elements.

6 Claims, 2 Drawing Sheets

BOW SIGHT MOUNT FOR ABSORBING THE FORCES OF SHEAR

BACKGROUND OF THE INVENTION

This invention relates to the mounting of a bow sight in position to absorb the vibration caused when the bow drawstring is released.

Archers typically use either a cross-hair or a single aiming pin in a suitable frame mounted in a bow sighting assembly so the frame can be adjusted horizontally, and sometimes vertically, to the desired aiming position. Usually the suport for the frame is rigid where the support engages the frame. The problem with that rigid contact is that the release of the bowstring exerts a sudden shock load at the attachment point with an excessive shearing force with the inevitable result that the frame connection can break, and sometimes does.

SUMMARY OF THE INVENTION

An object of the invention is to provide a more enlarged support for mounting of a bow sight frame to its sight structure.

Another object is to provide bow sight frame attachment which provides sufficient vibration resistance to accommodate shock and the incident forces of shear incident upon the release of a bow string.

A further object is to provide a cantilevered shock absorbing attachment that is a simple assembly of components associated with the bowsight frame.

Other and further objects of the invention will become apparent to those skilled in the art upon considering a preferred embodiment as set forth in the accompanying drawings.

DESCRIPTION OF THE PREFERRED EMBODIMENT

Figure 1:
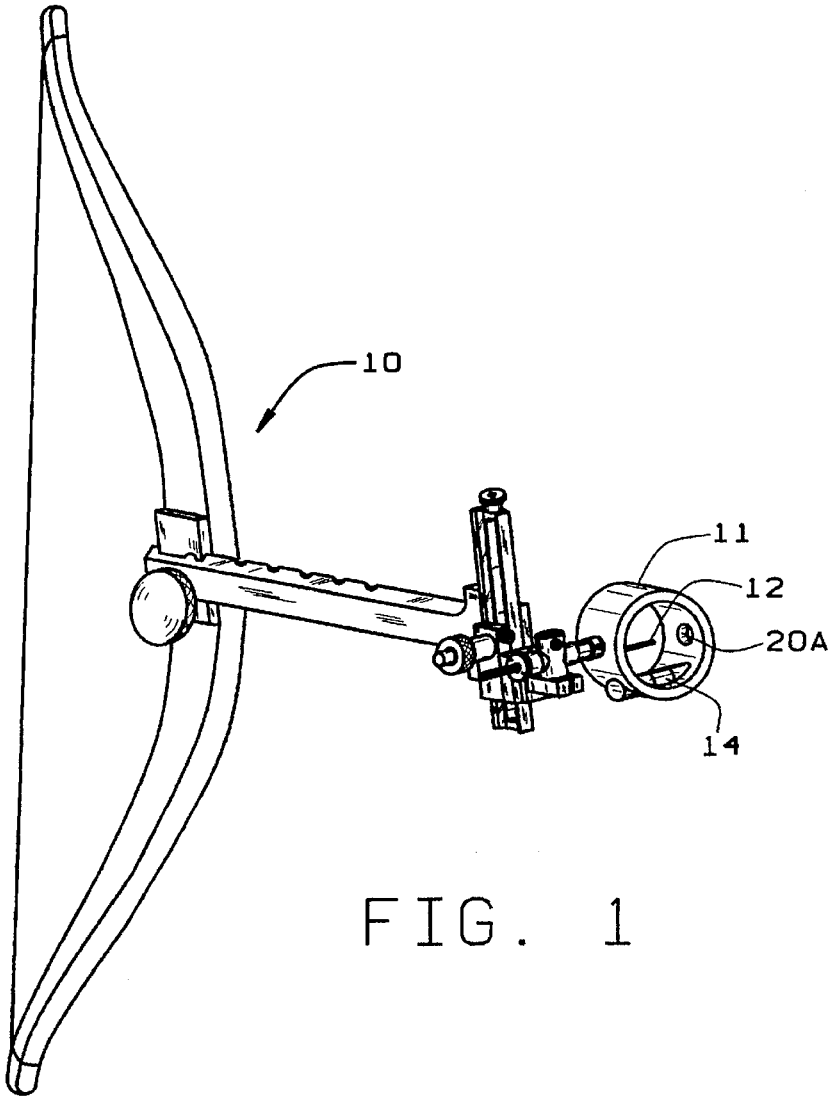
FIG. 1 is a perspective view of an archery bow with a sight mounting device on the bow to show environment.

The bow sight frame of FIG. 1 and its sight support is shown in assembly at 10, which comprises the frame 11 for the usual cross or lateral hairs (not shown) or a sight pin 12, as noted. That frame is connected to a threaded shaft which has been disclosed in a prior application, identified by Ser. No. 494,945, filed Jun. 26, 1995.

The details of the assembly 10 comprise the sight frame 11 having the sight pin 12 and a bubble level 14 arranged in the frame 11. Obviously, other types of sighting means may be employed. A threaded shaft or screw 13 extends from the interior of the frame 11, or laterally from its side, so that it is generally parallel with the bubble level 14 as well as the sight pin 12. An alignment sleeve 16 is threaded up on the shaft 13 until its enlarged head 17 approaches the exterior cylindrical surface of the frame 11. The head 17 carries a pair of alignment elements 18 which extend through the head 17 from ends 19 and which engage on the frame 11. These elements 18 extend through the apertures 15 provided through the head 17. The alignment elements 18 have blanks lying along the shaft 13 on diametrically opposite sides of the aperture 20 in the frame 11. The aperture 20, and the aligned larger aperture 20A, in the frame receives the shaft 13 which carries a bushing 22 having an integral head flange 23 that lies adjacent the head 15*a* of the shaft 13.

This bushing 22 is part of the shock absorbing system for this sight frame. The bushing may be fabricated of any polymer, or nylon, or of any other material that adds a little resiliency to the mounting of the sight frame 11 to the assembly 10, so as to effectively absorb, or attempt to dampen, the shear forces that are exterted at this location, where the alignment sleeve 16 threadily fastens against the curved outer surface of the contiguous frame 11, by means of the tightening of the threaded screw 13.

This bushing 22 locates within the frame aperture 20, as noted, and incorporates a separate pad 21, generally made of the same material, which is placed at the head of the sleeve head 17, so that it lies outside of the frame 11, when assembled. Obviously, the head flange 23, of the bushing 22, lies interiorly of the frame 11, when these components are assembled together, in the manner as described. The pad 21 is formed with peripheral notches that also accommodate the ends 19 of the alignment elements 18, and which ends 19 also extend into shallow counterbores provided within the surface of the frame 11, generally aligned vertically into the said outer surface of the frame 11.

Figure 3:
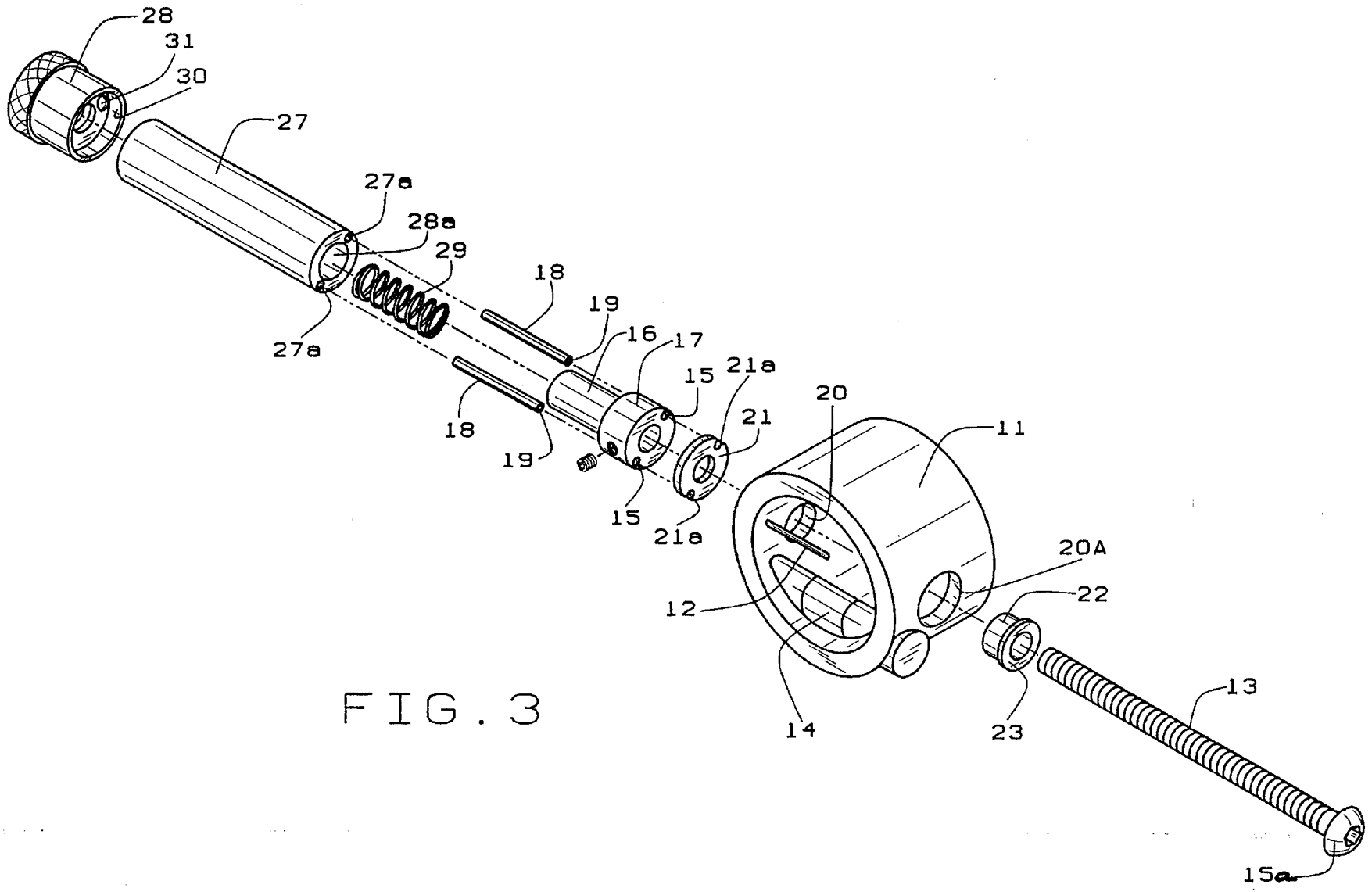
FIG. 3 is an exploded view of an archery sight frame and the support attachment of this invention.

The several parts described above are assembled with the frame 11, and the various associated parts as described herein function generally as shock absorbers in the following manner, with reference to FIG. 3. The shaft 13 is passed through the enlarged aperture 20A, which is greater in diameter than the diameter of the screw head 15, and receives the sleeve 22, so that as the head 23 abuts against the inner surface of the frame 11, and the screw 13 is tightened within the theaded interior of the sleeve head 17, and tightened therein, the combination of the screw 13, the sleeve 22, and its various head flange 23 in addition to the pad 21 tightly abut against the inner and outer contiguous surface of the frame 11, when the screw becomes tightened within the alignment sleeve 16, and tightened in position. Obviously, an Allen wrench, or the like, may be inserted within the screw head 15, to tighten it snuggly to provide for securement of all of these components together. In addition, as that occurs, the alignment elements 18 will be conveniently aligned through the apertures 15, rest within the notches 21*a*, and insert within the counterbores provided within the outer surface of the frame 11, as previously described.

Figure 2:
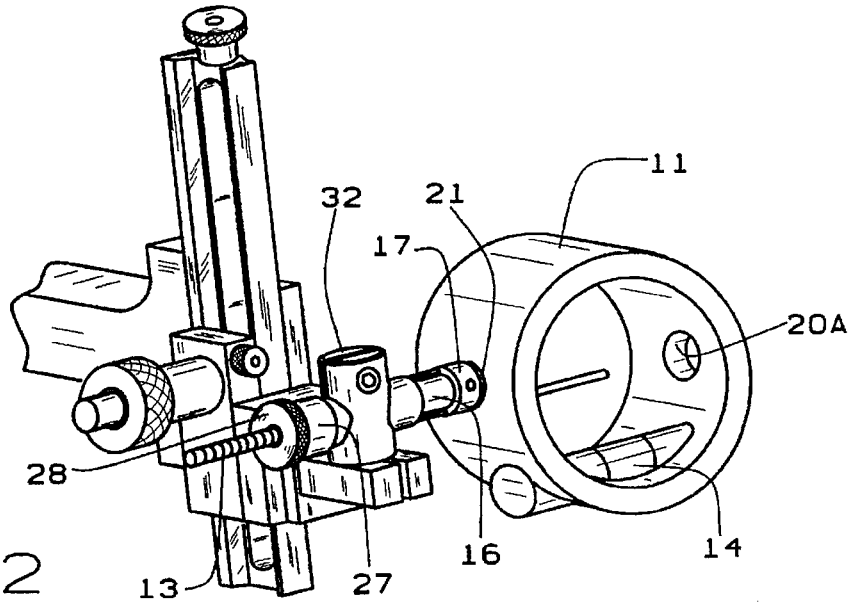
FIG. 2 is a perspective view of an archery sight mounting device of this invention.

The final assembly of the bow sight on the bow is by attachment of the sleeve member 27 that slides over the threaded screw 13. The front edge of the member 27 includes also a pair of counterbores, as at 27A, and the backend of the alignment elements 18 insert therein, to sustain alignment of the sleeve member 27 thereon. In addition, a spring 29 inserts within the counterbore opening formed through the front end of the member 27, as can be seen at 28A, and the coil spring 29 inserts therein, and additionally inserts within a counterbore formed through the back end of the alignment sleeve 16. Thus, the sleeve member 27 is constantly biased rearwardly, with respect to the sleeve 16, to accommodate the indexing cap 28, that threadily connects onto the back end of the threaded screw 13, extending out the rear edge of the said member 27. The cap 28 secures proximate and upon the back of the sleeve member 27, which inserts within the counterbore 30 and is biased thereagainst, by means of the force of the spring 29. An index ball, that functions as a detent, as shown at 31, indexes it against the back edge of the sleeve 27, for purposes of adjustment of the entire sight frame assembly 11, laterally of its assembly 10, in a manner as known in the art. As can be seen in FIG. 2, a mount 32 secures onto the sleeve member 27, to provide for that lateral shift of the sight frame 11, during adjustment of its associated knurled cap 28.

The foregoing assembly achieves a shock absorbing benefit that avoids, generally, breakage of the enlarged threaded screw 13, where it connects with the frame 11, wherein the prior art, the use of a singular screw, without any cushioning means, such as the sleeve 22, would normally break under the shear force that is exerted at that point, due to the momentum generated forwardly at the edge of the sight frame 11, where the screw would connect therethrough, for mounting it to its mounting means 32, as previously described.

Variations or modifications to the subject matter of this invention may occur to those skilled in the art upon a review of the subject matter described herein. Such variations or modifications, if within the spirit of this invention, are intended to be encompassed within the scope of any claims to patent protection issuing upon this development. The description of the preferred embodiment set forth herein is done so for illustrative purposes only.

I claim:

1. An archery bow and bow string having a bowsight frame carried by the bow subject to vibration shock and shear forces on release of the bow string comprising a vibration shock absorbing attachment for the bowsight frame having a threaded shaft projecting outwardly from said bowsight frame, said shaft having a headed end in said frame, a bushing received on said shaft in said frame with a headed end abutted by said shaft headed end, a sight alignment sleeve threaded upon said shaft, said alignment sleeve also having a headed end presented against said frame, and a shock pad disposed on said shaft between said sleeve headed end and said frame.

2. The bowsight vibration shock absorbing attachment set forth in claim 1 wherein said headed end on said bushing and said shock pad are formed of polymer and inherently resilient to absorb vibration shock loads and shear forces.

3. The bowsight vibration shock absorbing attachment as set forth in claim 1, wherein said shaft is threaded throughout its length, said bushing being slidably received on said shaft, and said threaded shaft tightly securing within said alignment sleeve to tighten said bushing and its shock pad against the bowsight frame to resist against the impact of shearing forces during usage of the archery bow.

4. The bow sight vibration shock absorbing attachment of claim 3 and including a cap retainer engaged on said threaded shaft in position to retain said alignment sleeve in an adjusted position upon the threaded shaft.

5. The invention of claim 4 and including a spring containing member engaged against said alignment sleeve and biasing said alignment sleeve against said cap retainer.

6. The bow sight frame as set forth in claim 1 wherein said threaded shaft connects said frame in a cantilevered mounting having shock absorbing attributes to resist against shear of the threaded shaft.

* * * * *

UNITED STATES PATENT AND TRADEMARK OFFICE

CERTIFICATE OF CORRECTION

PATENT NO. : 5,644,849

DATED : July 8,. 1997

INVENTOR(S) : Scott O. Slates

It is certified that error appears in the above-indentified patent and that said Letters Patent is hereby corrected as shown below:

Title page item [73],
change name of Assignee, from "Toxonigs Manufacturing, Inc." to ---Toxonics Manufacturing, Inc.---.

Signed and Sealed this

Sixteenth Day of September, 1997

*Attest:*

Bruce Lehman

BRUCE LEHMAN

*Attesting Officer*

*Commissioner of Patents and Trademarks*